United States Patent [19]

Guzorek

[11] Patent Number: 4,757,802

[45] Date of Patent: Jul. 19, 1988

[54] POWER VENTER

[75] Inventor: Steven E. Guzorek, Kinston, N.C.

[73] Assignee: The Field Controls Company, Kinston, N.C.

[21] Appl. No.: 98,089

[22] Filed: Sep. 18, 1987

[51] Int. Cl.[4] ..... F24C 1/14

[52] U.S. Cl. ..... 126/80; 110/162; 98/48; 126/312

[58] Field of Search ..... 126/312, 307 R, 301, 126/80; 110/162; 98/48

[56] References Cited

U.S. PATENT DOCUMENTS

| | | | |
|---|---|---|---|
| 2,711,683 | 6/1955 | Ryder | 98/48 |
| 2,713,301 | 7/1955 | McKann | 98/46 |
| 2,916,983 | 12/1959 | Kinkead | 98/48 |
| 3,105,432 | 10/1963 | Chamberlain | 98/48 X |
| 3,136,309 | 6/1964 | Martz | 126/307 R X |
| 3,211,080 | 10/1965 | Rader | 98/72 |
| 3,431,056 | 3/1969 | Winegardner | 431/20 |
| 3,527,177 | 9/1970 | LaRue | 110/8 |
| 3,782,303 | 1/1974 | Pfister et al. | 110/162 |
| 4,250,868 | 2/1981 | Frye | 126/121 |
| 4,424,792 | 1/1984 | Shimek et al. | 126/80 |

FOREIGN PATENT DOCUMENTS 925772 5/1963 United Kingdom .

OTHER PUBLICATIONS

A brochure of State Industries of Unknown Date.
A literature page of Tjernlund Products, Inc. bearing a copyright date of 1985.
A brochure of The Field Controls Company published Aug. 1985.

*Primary Examiner*—Randall L. Green

*Attorney, Agent, or Firm*—Wood, Dalton, Phillips, Mason & Rowe

[57] ABSTRACT

A power venter for connection to an appliance vent system to provide draft and gas flow and which has components mounted exteriorly of a building wall and components extending through the wall, with the latter components including an inner pipe connectable to a vent pipe of a vent system and an outer pipe surrounding the inner pipe in spaced relation functioning as a heat shield and providing an annular space therebetween. The outside components include a vent hood with a blower housing mounted interiorly thereof and having a blower with an inlet communicating with an outside end of the inner pipe and having a blower outlet to atmosphere. An orifice plate is associated with the blower to separate positive and negative pressure areas and has an orifice opening leading to an eye of the blower, with the blower rotatable about an axis offset from the longitudinal axis of the inner pipe to provide a desired blower diffuser angle. The scroll of the blower housing is defined by an outside section of one of the pipes and, more particularly by a section of the outer pipe whereby the outer pipe diameter may be selected for the desired diameter of blower wheel without affecting the diameter of the inner pipe which connects to the vent system. The annular space between the inner and outer pipes communicates with the outside for flow of outside air into the annular space and with this annular space either connectable to a duct extending to a fuel-burning appliance for supplying makeup air or being closed off at the inside end of the outer pipe for delivery to the flue gases within the inner pipe through an opening in the wall of the inner pipe.

20 Claims, 2 Drawing Sheets

FIG. 1
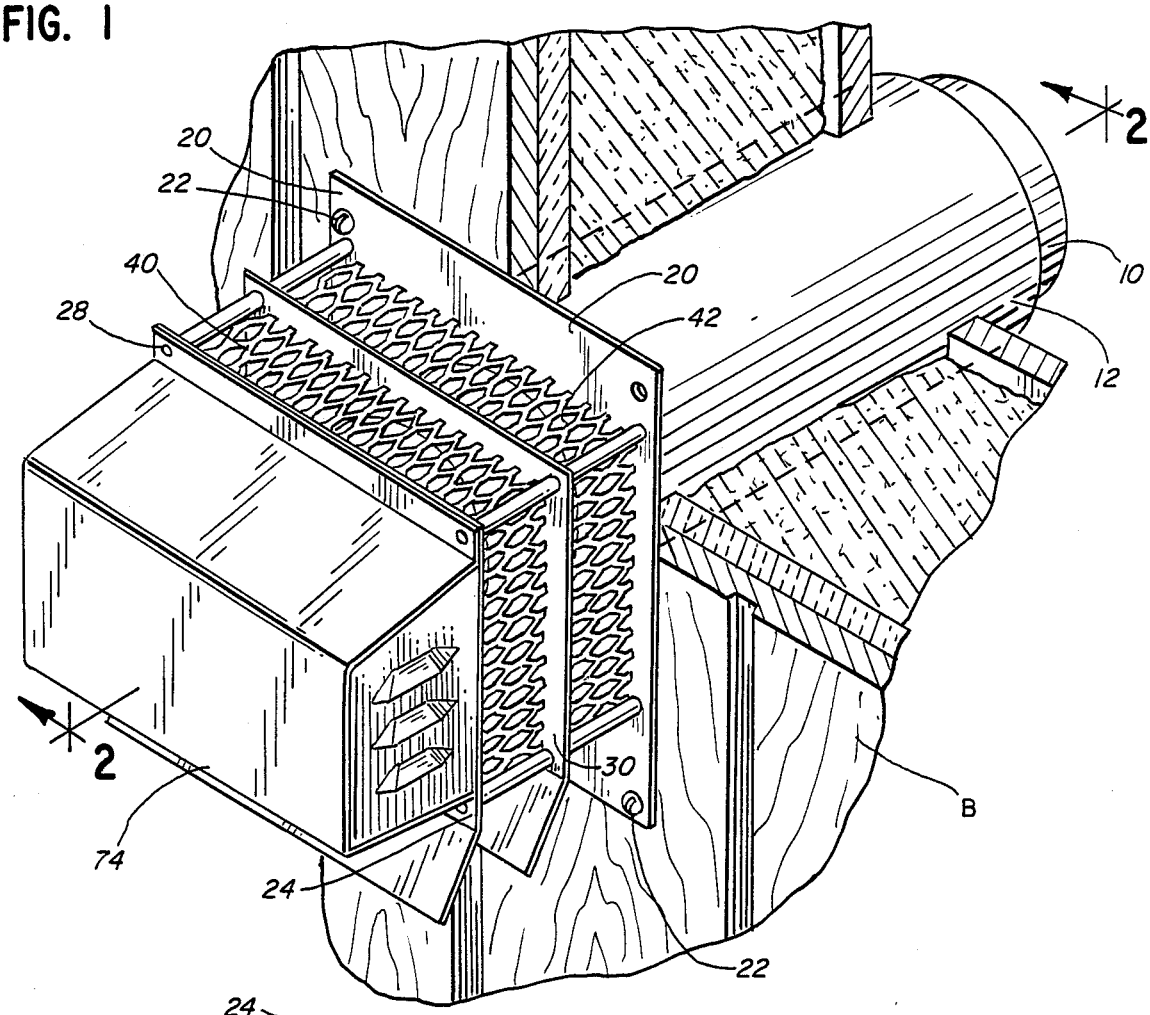
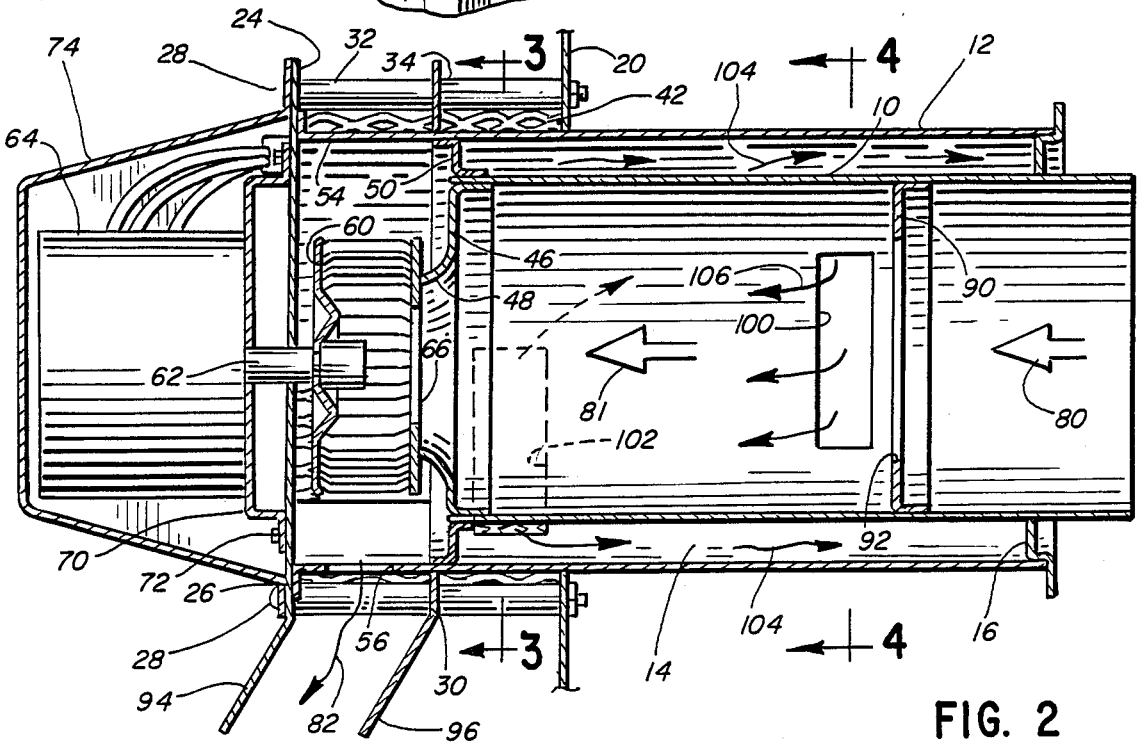
FIG. 2

FIG. 3
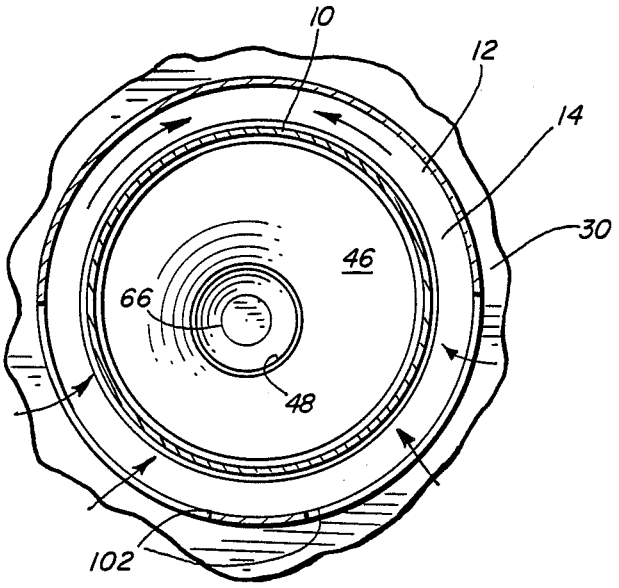
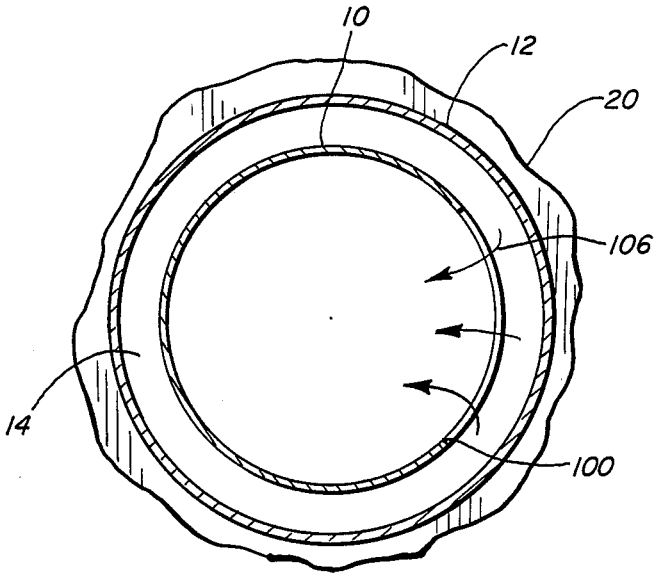
FIG. 4

POWER VENTER

DESCRIPTION

1. Field of the Invention

This invention pertains to a power venter for connection to an appliance vent system to provide draft and gas flow for a horizontal venting system which eliminates the need for a chimney.

2. Background of the Invention

Power venters are commercially available which have a housing and a blower and which can be connected into a vent pipe system from an appliance for providing draft and gas flow. These power venters are designed for connection to a vent pipe within a building and the vent system continues out through an exterior building wall for exhaust. Such an installation results in creating a positive pressure within that part of the vent system which is downstream of the blower. As a result, positive pressure exists in the vent pipe system within the building which can create a situation of possible leakage of combustion gases into a living or working space within the building due to inadequate sealing of the venting system. This problem can be solved by moving the positive pressure within the vent system to the outside of the building. This can be accomplished by having a blower connected into the vent system outside of the building wall whereby there is a negative pressure within the vent system within the building.

It is known in the prior art to have a forced draft vent assembly wherein a blower is mounted outside of a building wall for creating a draft and flow of combustion gases through a vent pipe for exhaust thereof outside the building. Such a structure is shown in Winegardner U.S. Pat. No. 3,431,056.

Another example of an externally-mounted power venter is shown in the Shimek U.S. Pat. No. 4,424,792. The Shimek patent also shows a connection of the vent pipe interiorly of the building wall with the outside atmosphere for flow of outside air into the vent pipe for mixture with the combustion gases prior to their flow across the plane of the building wall and to the blower.

SUMMARY OF THE INVENTION

A primary feature of the invention is to provide a power venter which combines the concept of power venting by means of a blower mounted externally of a building wall with a through-the-wall termination hood and with the power venter having new and novel structure not heretofore known in the art.

The power venter disclosed herein has an inner pipe connectabe to an appliance vent pipe and a surrounding outer pipe, both of which extend across the plane of a building wall and a blower housing at the outer ends of said pipes has parts thereof in common with a vent hood to form at least one side of the blower housing. A section of one of the pipes surrounds a motor-driven blower to define a centrifugal blower scroll.

An object of the invention is to provide a power venter having a mounting plate for attachment to the exterior of a building wall and which supports a blower housing and a pair of pipes which extend through a building wall to the interior of the building with an inner pipe connectable to an appliance vent system and an outer pipe surrounding the inner pipe to provide an annular space therebetween. The blower is rotatable about an axis parallel to the longitudinal axis of the inner pipe and the blower housing has a pair of spaced-apart side walls, one of which has an opening aligned with the eye of the blower for flow of gas to the blower and the blower housing is completed by a section of one of said pipes defining a blower scroll and having at least one outlet opening for discharge of gas from the blower.

Another object of the invention is to provide a power venter as defined in the preceding paragraph wherein the annular space between the inner and outer pipes is open to outside air exteriorly of the building for counterflow of outside air through said annular space. This air is usable as makeup air for an appliance when the outer pipe is connected to a duct leading to the appliance or for supplying outside air for mixture with combustion gases flowing through the inner pipe when an inner end of said annular space is sealed and there is at least one opening through the wall of the inner pipe communicating the annular space with the interior of the inner pipe.

Still another object of the invention is to provide a power venter for connection to an appliance vent system to provide draft and gas flow comprising, an elongate inner pipe connectable at an inside end to an appliance vent system, an outer pipe surrounding said inner pipe and of a larger diameter to provide an annular space therebetween, said inner pipe and outer pipe being of a length to extend through a building wall to the exterior of a building to have an outside end of the inner pipe outside of a building and with the outer pipe defining a heat shield through the building wall, a mounting plate associated with said pipes and mountable to the building wall, a blower mounted adjacent said outside end of the inner pipe and having a blower wheel rotatable about an axis generally parallel with the longitudinal axis of the inner pipe, and a blower housing having spaced-apart side walls with the blower wheel mounted therebetween, and a section of one of said pipes extending between said spaced-apart walls to define the scroll of the blower housing and having an opening defining a blower outlet.

An additional object of the invention is to provide a power venter as defined in the preceding paragraph wherein said power venter includes a series of spaced-apart plates operatively supporting said inner and outer pipes, a first of said plates being said mounting plate attachable to a building, a second of said plates defining one side wall of said blower housing, and a third plate intermediate said first and second plates, said blower outlet located between said second and third plates, and downwardly and outwardly inclined deflector vanes extending along the bottom of said second and third plates.

Still another object of the invention is to provide a power venter for connection to an appliance vent system to provide draft and gas flow comprising, an elongate inner pipe connectable at an inside end to an appliance vent system, an outer pipe surrounding said inner pipe and of a larger diameter to provide an annular space therebetween, said inner pipe and outer pipe being of a length to extend through a building wall to the exterior of a building to have an outside end of the inner pipe outside of a building and with the outer pipe defining a heat shield through the building wall, a blower mounted adjacent said outside end of the inner pipe and having a blower wheel rotatable about an axis generally parallel with the longitudinal axis of the inner pipe, a mounting plate for support of said pipes mountable to the building wall, and a blower housing having spaced-apart walls with the blower wheel mounted therebetween, and a section of the outer pipe extending between said spaced-apart walls to define a cylindrical peripheral wall of the blower housing and having an opening defining a blower outlet.

A further object of the invention is to provide a power venter having a new and improved structure providing features not heretofore known in the art and which will be evident from the specification and claims set forth hereinafter.

DESCRIPTION OF THE DRAWINGS

FIG. 1 is a perspective view of the power venter shown mounted in a building wall, with parts of the building wall broken away for clarity;

FIG. 2 is a longitudinal central section of the power venter, with the plane of the section indicated generally by the line 2—2 in FIG. 1;

FIG. 3 is a vertical section, taken generally along the line 3—3 in FIG. 2; and

FIG. 4 is a vertical section, taken generally along the line 4—4 in FIG. 2.

DESCRIPTION OF THE PREFERRED EMBODIMENTS

The power venter is shown in FIG. 1 mounted to the outside wall of a building.

The power venter has an inner pipe 10 with an inside end 11 connectable to a vent pipe of a vent system extending from an appliance to provide draft and flow of combustion gases from the appliance to the outside of the building. A tubular member, in the form of an outer pipe 12, surrounds the inner pipe in spaced relation thereto and defines an annular space 14 therebetween. An inside end of the outer pipe 12 has an annular member 16 positioned therein to close off the inside end of the annular space 14. This annular member 16 is optionally usable, dependent upon the functions to be performed by the power venter and with its omission it is possible to connect the inside end of the outer pipe 12 to a duct extending to the combustion chamber of the fuel-burning appliance in order to provide for flow of outside air through the annular space and the duct to supply makeup air to the appliance.

A mounting plate 20 operatively supports the inner and outer pipes and can be mounted in abutting relation to the building wall, indicated generally at B, by means of fastening members 22.

The mounting plate 20 has an opening to surround the outer pipe 12, but need not be attached thereto and connects to a plate 24 secured to an out-turned flange 26 on an outside end of the outer pipe 12. The connection to plate 24 is by means of a series of elongate bolts 28 which extend from the plate 24 through the plate 20 and also extend through an intermediate plate 30. Each of the bolts has a pair of tubular spacers 32 and 34 fitted thereon, with the spacer 32 spacing the plate 30 from the plate 24 and the spacer 34 spacing the plate 20 from the plate 30. The plate 30 also has an opening for closely fitting in surrounding relation to the outer pipe 12. The space between the pairs of plates is enclosed by a pair of safety screens 40 and 42.

A blower housing, as part of the vent hood, has a pair of spaced-apart side walls, with the plate 24 defining one of the side walls and the other side wall being defined by an orifice plate 46 having an annular flange fitted within and secured to an outside end of the inner pipe 10 and having an offset opening 48 for delivering gas to the eye of a blower, to be described.

An annular member 50 surrounds the outside end of the inner pipe 10 and is fixed thereto as well as to the interior of the outer pipe 12 to securely locate the outside end of the inner pipe in the assembly.

The blower housing is additionally defined by a section of one of the pipes and, more particularly, the outside end section 54 of the outer pipe 12 to form a scroll for the blower and having a blower outlet opening 56 through the wall thereof.

A centrifugal blower wheel 60 is mounted within the blower housing for rotation about an axis defined by an output shaft 62 of a motor 64 which is parallel to and offset from the longitudinal axis of the inner pipe 10, as evidenced by the offset opening 48 of the orifice plate 46 which is generally symmetrical with the eye 66 of the blower wheel.

A mounting bracket 70 for the motor is attached to the plate 26 by fasteners 72 and the motor is enclosed within a cover 74 which can be attached to the plate 26 or, as shown, is secured thereto by means of the bolts 28.

Energization of the motor 64 results in rotation of the blower wheel 60 to induce a draft and flow of gas through the inner pipe 10 in the direction of the arrows 80 and 81, with flow from the blower through the blower outlet 56, as indicated by the arrow 82. The orifice plate 46 functions to separate positive and negative pressure areas in the vent system. An airflow control device can be mounted within the inner pipe 10 and such device can be in the form of a rotation-type turn damper, a barometric draft control, a slide member, or, as shown, a plate 90 having an opening 92 therein.

The hood plates 24 and 30 have their respective lower ends 94 and 96 extending downwardly and outwardly whereby gas flow from the blower is directed away from the building wall.

The offset of the axis of the blower wheel and the orifice 48 of the orifice plate 46 results in a lack of symmetry with the scroll defined by the outside section 54 of the outer pipe 12 to form a blower diffuser angle (housing expansion angle) of a desired value and the offset can be varied depending upon the desired flow conditions.

With the outside section 54 of the outer pipe defining the scroll of the blower housing, it will be noted that the power vent can be modified easily to achieve different flow requirements by different size blower wheels 60. The inner pipe 10 can remain of a fixed diameter to coact with a vent pipe of a vent system and the outer pipe 12 and structure associated therewith can be of a selected diameter to provide a desired scroll diameter for housing the selected size blower wheel.

The outer pipe 12 serves as a heat shield respecting the hot gases flowing through the inner pipe 10 and, if desired, particularly in a high temperature application, outside air can flow through the annular space 14 into the inner pipe 10 for mixing with the hot gases in the inner pipe. This results in cooler air existing in the annular space and can also assist in minimizing the effects of wind loads on the venting capacity. If a wind load is applied to the vent hood, this would cause a positive pressure at the blower outlet 56. However, through the annular space 14 the same amount of pressure would be applied to the gases in the inner pipe 10, which should minimize the effects of wind loads on the venting capacity. This function is achieved by having the inside end of the outer pipe 12 closed by the annular member 16 and providing at least one opening 100 in the wall of the inner pipe 10. The outer pipe 12 has at least one opening at a location between the plates 20 and 30, which is open to the outside air, whereby outside air can flow into the annular space 14, as indicated by arrow 104 and then flow into the inner pipe, as indicated by the arrows 106.

I claim:

1. A power venter for connection to an appliance vent system to provide draft and gas flow comprising, an elongate inner pipe connectable at an inside end to an appliance vent system, an outer pipe surrounding said inner pipe and of a larger diameter to provide an annular space therebetween, said inner pipe and outer pipe being of a length to extend through a building wall to the exterior of a building to have an outside end of the inner pipe outside of a building and with the outer pipe defining a heat shield through the building wall, a mounting plate associated with said pipes and mountable to the building wall, a blower mounted adjacent said outside end of the inner pipe and having a rotatable blower wheel mounted transversely to the longitudinal axis of the inner pipe, and a blower housing having spaced-apart side walls with the blower wheel mounted therebetween, and a section of one of said pipes extending between said spaced-apart walls to define the scroll of the blower housing and having an opening defining a blower outlet.

2. A power venter as defined in claim 1 including a series of spaced-apart plates operatively supporting said inner and outer pipes, a first of said plates being said mounting plate attachable to a building, a second of said plates defining one side wall of said blower housing, and a third plate intermediate said first and second plates, said blower outlet located between said second and third plates, and downwardly and outwardly inclined deflector vanes extending along the bottom of said second and third plates.

3. A power venter as defined in claim 1 including means in said inner pipe upstream of said blower for controlling gas flow to the blower.

4. A power venter as defined in claim 3 wherein said means for controlling gas flow comprises a flow restrictor plate fitted in said inner pipe.

5. A power venter as defined in claim 1 wherein one of said side walls is an orifice plate for separating positive and negative pressure areas and having an opening at the eye of the blower.

6. A power venter as defined in claim 1 wherein said annular space is closed off adjacent the inside end of the inner pipe, and means including said annular space for communicating the interior of the inner pipe adjacent said inside end thereof with the ambient air outside of a building.

7. A power venter as defined in claim 1 wherein an outside end of the outer pipe is open to outside air.

8. A power venter for connection to an appliance vent system to provide draft and gas flow comprising, an elongate inner pipe connectable at an inside end to an appliance vent system, an outer pipe surrounding said inner pipe and of a larger diameter to provide an annular space therebetween, said inner pipe and outer pipe being of a length to extend through a building wall to the exterior of a building to have an outside end of the inner pipe outside of a building and with the outer pipe defining a heat shield through the building wall, means closing off an end of said annular space adjacent said inside end of the inner pipe, a blower mounted adjacent said outside end of the inner pipe and having a blower wheel rotatable about an axis generally parallel with the longitudinal axis of the inner pipe, a mounting plate operatively connected to said pipes and mountable to the building wall, a blower housing having spaced-apart walls with the blower wheel mounted therebetween, a section of one of said pipes extending between said spaced-apart walls to define a cylindrical peripheral wall of the blower housing and having an opening defining a blower outlet, and means for exposing the interior of the inner pipe to outside air by having an outside end of the outer pipe open to atmosphere and at least one opening through the wall of the inner pipe communicating with said annular space.

9. A power venter as defined in claim 8 wherein one of said blower housing walls is defined by an orifice plate with an opening to an inlet for the blower in order to separate positive and negative pressure areas.

10. A power venter for connection to an appliance vent system to provide draft and gas flow comprising, an elongate inner pipe connectable at an inside end to an appliance vent system, a tubular member surrounding said inner pipe and of a larger diameter to provide an annular space therebetween, said inner pipe and tubular member being of a length to extend through a building wall to the exterior of a building to have an outside end of the inner pipe, a blower mounted adjacent said outside end of the inner pipe and having a blower wheel extending transversely to the series of spaced-apart plates operatively connected to said inner pipe and tubular member at the outer ends thereof to be located outside a building, a first of said plates being attachable to a building, a second of said plates defining an outer wall for a chamber housing said blower, and a third plate intermediate said first and second plates, a downwardly-opening blower outlet located between said second and third plates, and downwardly and outwardly inclined deflector vanes extending along the bottom of said second and third plates said blower housing for said blower wheel including, in addition to said second plate, a cylindrical peripheral wall defined by a section of said tubular member, and said blower outlet being formed in said section of the tubular member.

11. A power venter as defined in claim 10 including means in said inner pipe upstream of said blower for controlling gas flow to the blower.

12. A power venter as defined in claim 11 wherein said means for controlling gas flow comprises a flow restrictor plate fitted in said inner pipe.

13. A power venter as defined in claim 10 including an orifice plate positioned in said inner pipe upstream of said blower, said blower wheel having an axis offset from the longitudinal axis of the inner pipe, and said orifice plate having an opening aligned with the eye of the blower wheel.

14. A power venter as defined in claim 10 wherein said tubular member functions as a heat shield and means for flowing outside air through said annular space to minimize heat buildup on the tubular member.

15. A power venter as defined in claim 10 including means closing off an end of said annular space adjacent said inside end of the inner pipe, and wherein said inner pipe has at least one opening adjacent its inside end which communicates with said annular space, and said tubular member adjacent the outer end thereof being open to atmosphere whereby the effects of wind loads on venting capacity can be minimized and outside air can flow through said annular space to reduce heat buildup on the tubular member.

16. A power venter for connection to an appliance vent system to provide draft and gas flow comprising, an elongate inner pipe connectable at an inside end to an appliance vent system, an outer pipe surrounding said inner pipe and of a larger diamter to provide an annular space therebetween, said inner pipe and outer pipe being of a length to extend through a building wall to the exterior of a building to have an outside end of the inner pipe outside of a building and with the outer pipe defining a heat shield through the building wall, means closing off an end of said annular space adjacent said inside end of the inner pipe, a blower mounted adjacent said outside end of the inner pipe and having a blower wheel rotatable about an axis extending in the same direction as the longitudinal axis of the inner pipe, a mounting plate for support of said pipes mountable to the building wall, and a blower housing having spaced-apart walls with the blower wheel mounted therebetween, and a section of the outer pipe extending between said spaced-apart walls to define a cylindrical peripheral wall of the blower housing and having an opening defining a blower outlet.

17. A power venter as defined in claim 16 including means in said inner pipe upstream of said blower for controlling gas flow to the blower.

18. A power venter as defined in claim 16 including an orifice plate positioned in said inner pipe upstream of said blower, said blower wheel axis being offset from the longitudinal axis of the inner pipe, and said orifice plate having an opening aligned with the eye of the blower wheel.

19. A power venter as defined in claim 16 including means connecting said annular space to atmosphere outside the building and to the interior of the inner pipe adjacent the inner end thereof.

20. A power venter as defined in claim 16 wherein said inner pipe has at least one opening adjacent its inside end which communicates with said annular space, and said outer pipe adjacent the outer end thereof being open to atmosphere whereby the effects of wind loads on venting capacity can be minimized and outside air can flow through said annular space to reduce heat buildup on the outer pipe.

* * * * *